US010988892B1

(12) United States Patent
Lu

(10) Patent No.: US 10,988,892 B1
(45) Date of Patent: Apr. 27, 2021

(54) DOUBLE-DECKER CLOTH RACK

(71) Applicant: Zhiqiang Lu, Shenzhen (CN)

(72) Inventor: Zhiqiang Lu, Shenzhen (CN)

( * ) Notice: Subject to any disclaimer, the term of this patent is extended or adjusted under 35 U.S.C. 154(b) by 0 days.

(21) Appl. No.: 16/942,794

(22) Filed: Jul. 30, 2020

(51) Int. Cl.
*D06F 57/06* (2006.01)
*A47G 25/06* (2006.01)

(52) U.S. Cl.
CPC ..... *D06F 57/06* (2013.01); *A47G 25/0664* (2013.01)

(58) Field of Classification Search
CPC ..... D06F 57/06; A47G 25/0664; A47G 25/06; A47G 25/0671; A47G 25/0692; A47B 43/00; A47B 61/003; A47B 47/0008; A47B 47/0016; A47B 47/00; A47B 47/0058; A47F 5/13; A47F 7/24; A47F 5/103
USPC ..... 211/204, 206, 182, 123, 105.1; D6/552, D6/675.5, 672, 681, 681.2
See application file for complete search history.

(56) References Cited

U.S. PATENT DOCUMENTS 850,658 A * 4/1907 Koonce ..... A47B 43/04 312/6
1,710,514 A * 4/1929 Reichert ..... A47B 47/027 248/188.1
2,302,233 A * 11/1942 Maddox ..... A47G 25/0664 211/123
3,144,946 A * 8/1964 Ellis ..... F16B 7/1418 211/182
3,503,525 A * 3/1970 Loebner ..... A47G 25/0664 211/206
3,620,377 A * 11/1971 Holtz ..... A47G 25/0664 211/206
3,863,769 A * 2/1975 Goddard ..... A47F 5/13 211/182
3,960,275 A * 6/1976 Haughton ..... A47F 5/13 211/182
4,054,209 A * 10/1977 Solomon ..... A47F 7/24 211/208
4,138,046 A * 2/1979 De Freze ..... B60R 9/00 211/182
4,427,379 A * 1/1984 Duran ..... B62B 3/00 211/182
4,684,091 A * 8/1987 Moreschi ..... F16M 11/046 211/182
4,934,015 A * 6/1990 Mink ..... A47L 4/04 15/268
5,044,505 A * 9/1991 Spratt ..... A47B 57/54 211/22
5,257,794 A * 11/1993 Nakamura ..... B62B 3/00 211/182
D346,081 S * 4/1994 Turner ..... D6/681.1
5,520,293 A * 5/1996 Hartley ..... A47B 47/04 211/182
5,617,962 A * 4/1997 Chen ..... A47G 25/0664 211/204
5,718,344 A * 2/1998 Joldeson ..... A47F 5/13 211/182

(Continued)

*Primary Examiner* — Jennifer E. Novosad
(74) *Attorney, Agent, or Firm* — WPAT Law, P.C.; Anthony King

(57) ABSTRACT

A double-decker cloth rack including a base, at least two vertical tubes, one middle horizontal tube, top horizontal tube, two tri-connect coupler with a screw-on locking nut, wherein the tri-connect coupler connects the vertical tubes to the middle horizontal tube. There are also two tri-connect horn coupler to which two extension pieces are respectively connected.

10 Claims, 8 Drawing Sheets

(56) References Cited

U.S. PATENT DOCUMENTS 5,743,412 A * 4/1998 Noble ..... A47F 1/121 211/182
6,027,000 A * 2/2000 Sterzel ..... B60R 7/02 211/182
6,116,437 A * 9/2000 Rowe ..... F28D 1/04 211/119.008
6,168,031 B1 * 1/2001 Schmidt ..... A47B 88/00 211/46
6,390,311 B1 * 5/2002 Belokin ..... A61M 5/1415 211/189
6,401,948 B1 * 6/2002 Huang ..... A47F 5/137 211/206
6,745,909 B1 * 6/2004 Lai ..... A47G 25/0664 211/204
6,761,274 B1 * 7/2004 Chen ..... A47B 45/00 211/204
6,796,446 B2 * 9/2004 Segall ..... A47G 25/0664 211/204
7,077,277 B2 * 7/2006 Wang ..... A47B 91/02 182/186.7
D546,013 S * 7/2007 Pong ..... D32/58
D753,940 S * 4/2016 Ruiz ..... D6/681
9,423,181 B2 * 8/2016 Jacques ..... F26B 21/004
D777,483 S * 1/2017 Bittie ..... D6/681
9,648,949 B1 * 5/2017 Penaflor ..... A47B 81/00
10,264,878 B1 * 4/2019 Liu ..... A47B 88/40
D875,266 S * 2/2020 Qiu ..... D24/213
D882,309 S * 4/2020 Yang ..... D6/681.1
10,813,832 B2 * 10/2020 Qiu ..... A63B 1/00
2004/0112854 A1 * 6/2004 Lai ..... A47G 25/0664 211/206
2007/0131635 A1 * 6/2007 Shieh ..... A47B 47/0058 211/204
2007/0163974 A1 * 7/2007 Lai ..... A47G 25/0664 211/85.3
2007/0272642 A1 * 11/2007 Baptiste ..... A47B 43/00 211/201
2008/0029473 A1 * 2/2008 Hu ..... A47G 25/0664 211/206
2009/0001033 A1 * 1/2009 Sung ..... A47B 43/04 211/85.3
2009/0184073 A1 * 7/2009 Lu ..... A47B 61/003 211/85.3
2015/0008201 A1 * 1/2015 Qiang ..... D06F 57/06 211/85.3

* cited by examiner

DOUBLE-DECKER CLOTH RACK

FIELD OF THE DISCLOSURE

The present disclosure relates to a cloth rack and, more particularly, a double-decker cloth rack.

BACKGROUND OF THE DISCLOSURE

Currently known adjustable double-decker cloth racks are not sufficiently strong such that when the cloth rack is bearing near its maximum load, the rack can become shaky when a user pushes it to move it about on its wheels. This may cause damage to its plastic base, as well as causing separation of its couplers from its middle horizontal tube, thereby collapsing the entire cloth rack.

There is a continuing need for structurally sound cloth racks.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned needs. Although the present embodiments may obviate one or more of the above-mentioned needs, it should be understood that some aspects of the embodiments might not necessarily obviate them.

BRIEF SUMMARY OF THE DISCLOSURE

To overcome the deficiencies found in existing cloth rack designs, the instant disclosure provides a structurally reenforced and ease-of-use cloth rack.

In one contemplated embodiment, the disclosure provides a double-decker cloth rack having a base and at least two vertical tubes extending from the base. There can be a middle horizontal tube disposed in between the two vertical tubes. The two terminal ends of the middle horizontal tube are each connected to a vertical tube via a tri-connect coupler. Each tri-connect coupler has a slit across a horizontal tube body on the outside of which has helical tracks.

There can be provided a locking nut to screw onto the helical track to decrease the divide of the slit, thereby tightening the horizontal tube body as the horizontal tube body envelopes the terminal end of the middle horizontal tube. This beneficially improves the structural integrity of the cloth rack especially when a heavy load is being carried by the cloth rack. Each vertical tube consists of a top tube and a bottom tube, both of which are connected to the tri-connect coupler. The top terminal end of each top tube is connected to a tri-connect horn coupler. Between the two tri-connect coupler is disposed a top horizontal tube. Each of the tri-connect horn coupler also connects to an extension piece. The extension piece telescopically inserts within the perspective terminal end of the top horizontal tube.

Preferably, the tri-connect horn coupler has an elbow corner structural support piece. The base includes two horizontal slats connecting two end pieces. Each of the end pieces can have a hollow body within which there can be two parallel transversely disposed support in the form of a short wall that connects one interior side of the end piece to the opposing interior wall of the end piece.

Each of the extension pieces can have at least one notch to indicate a depth to which the extension piece is inserted into the top horizontal tube.

There can also be end caps disposed at the distal end of each extension piece, which can be hollow.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

Figure 1:
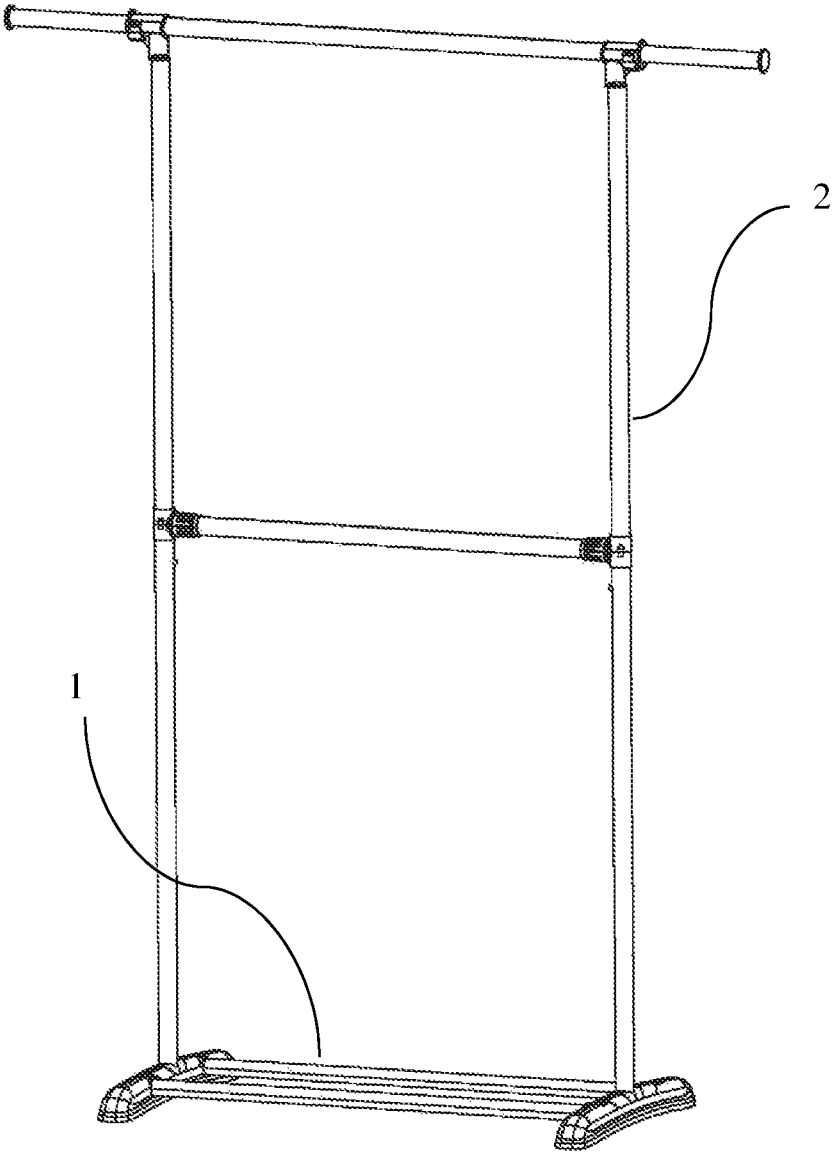
FIG. 1 is a perspective view of one embodiment of the double-decker cloth rack according to an aspect of the disclosure.
Figure 2:
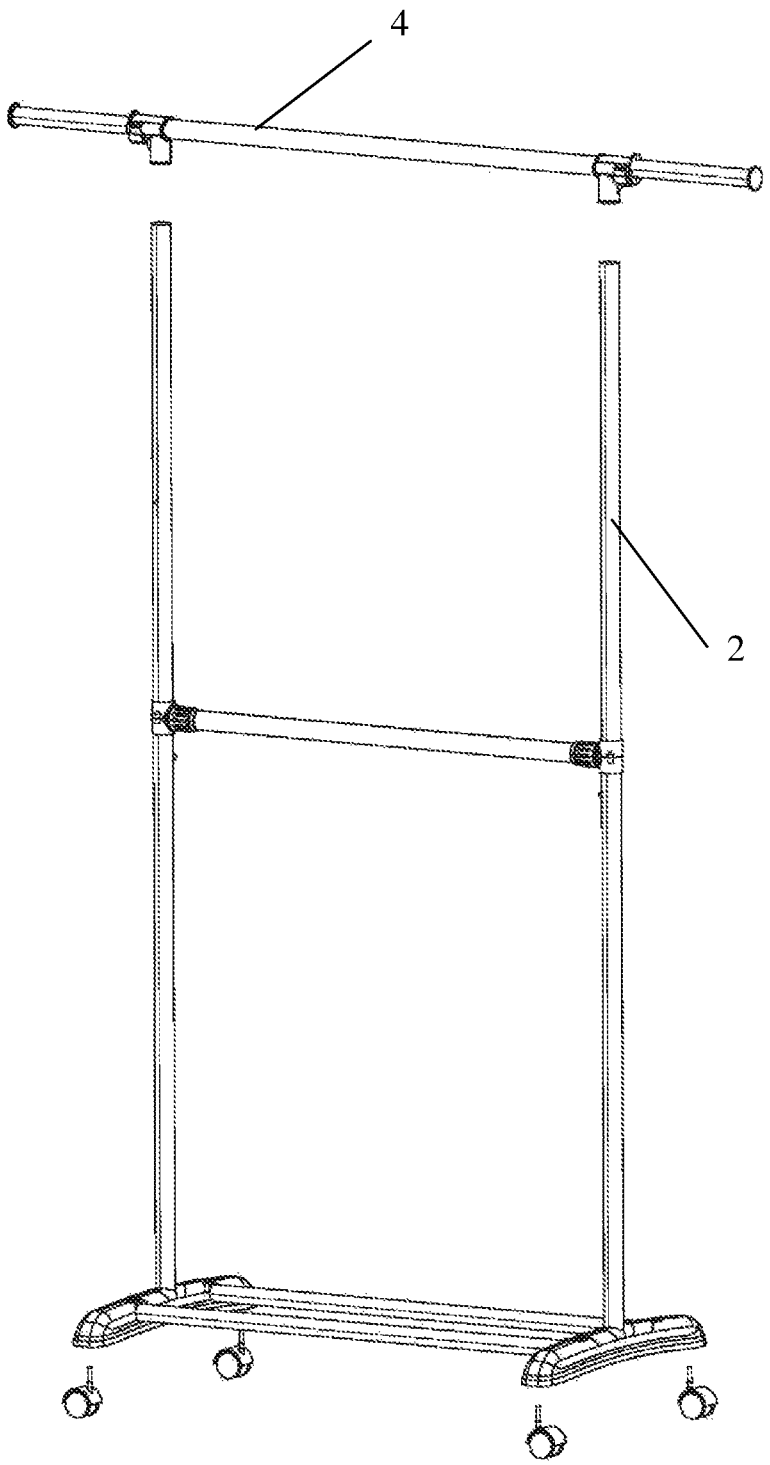
FIG. 2 is an exploded view of the top portion of the embodiment of FIG. 1 having wheels.

The different aspects of the various embodiments can now be better understood by turning to the following detailed description of the embodiments, which are presented as illustrated examples of the embodiments as defined in the claims. It is expressly understood that the embodiments as defined by the claims may be broader than the illustrated embodiments described below.

As shown in FIGS. 1-11, a double-decker cloth rack includes a base 1, at least two vertical tubes 2 that are coupled to the base 1. There can be a middle horizontal tube 3 that is disposed between the two vertical tubes 2. There can be a top horizontal tube 4 disposed between and coupled to the top ends of the two vertical tubes 2. There can be two tri-connect couplers 5 that functions to connect the two terminal ends of the middle horizontal tube 3 onto the two vertical tubes 2. There can be two tri-connect horn couplers 6 that functions to connect the top horizontal tube 4 to the top ends of the two vertical tubes 2.

Figure 6:
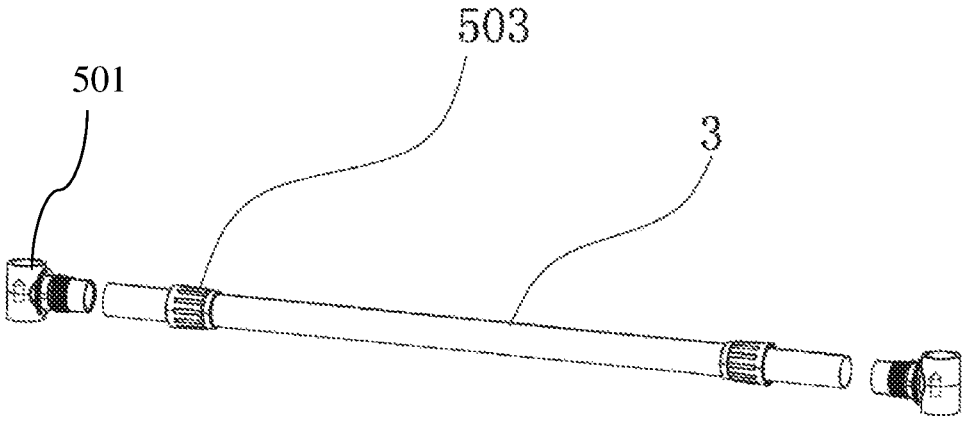
FIG. 6 is a perspective view of the horizontal tube and two tri-connect coupler of the cloth rack of FIG. 1.

In one embodiment, each of the tri-connect couplers 5 can include a vertical tube body 501, a vertical tube body 502 that functions to enclose a terminal end of the middle horizontal tube 3. Vertical tube body 502 and horizontal tube body 502 can be made of one integral part. As shown in FIG. 6, there can be a detachable locking nut 503 that can screw onto the vertical tube body 502 in order to clamp the vertical tube body 502 onto a terminal end of the middle horizontal tube 3. In one embodiment, the horizontal tube body 501, the vertical tube body 502, and the locking nut 503 each has a diameter that is different from one another.

Figure 3:
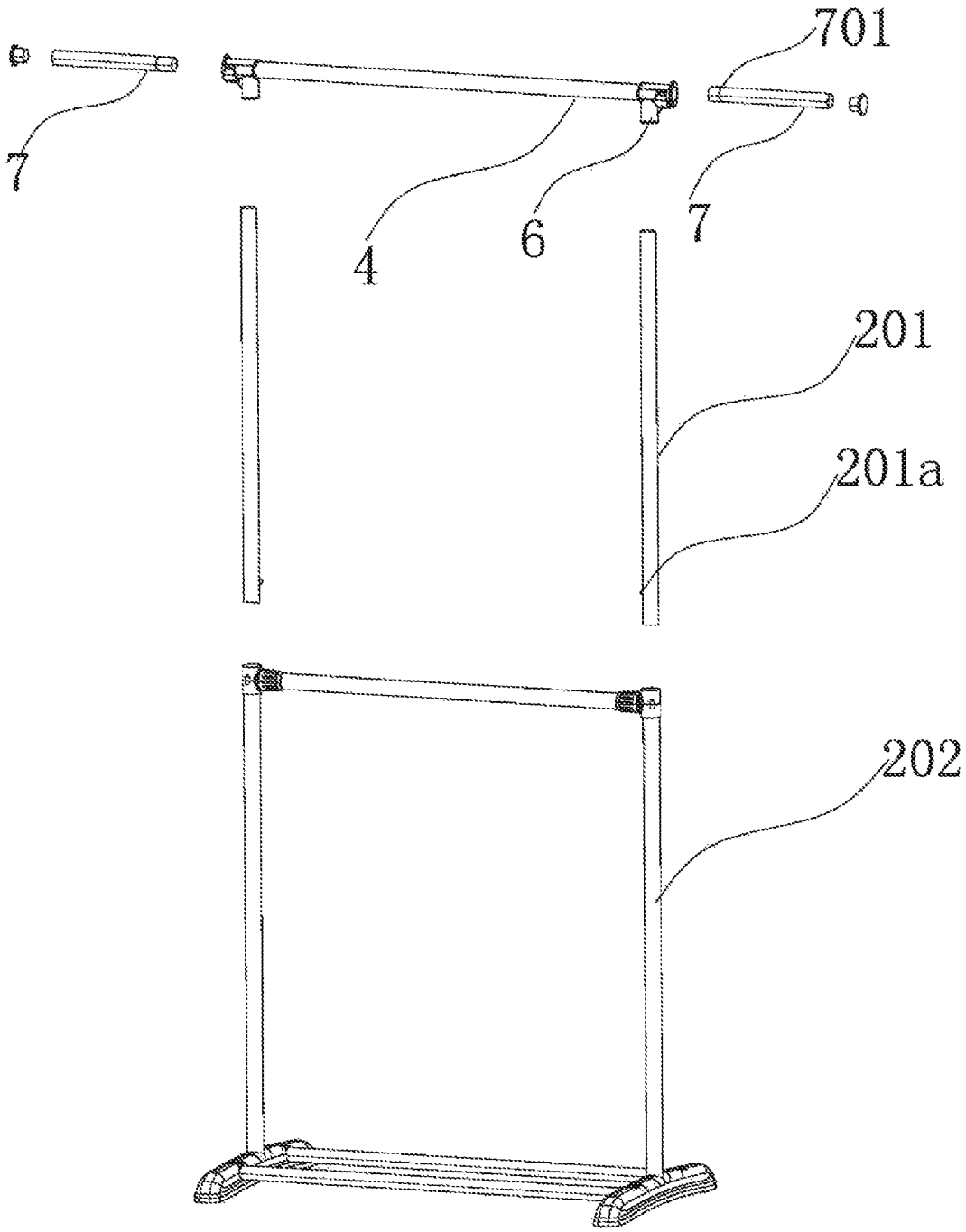
FIG. 3 is a fully exploded view of the embodiment of FIG. 1.

Referring now to FIG. 3, each side of the vertical tubes 2 consists of two parts, a top tube 201 and bottom tube 202. Top tube 201 can be telescopically received within bottom tube 202. There can be a leaf spring push button 201*a* disposed within the top tube 201 to complementarily fit within openings 202*a* (see FIG. 4) disposed on the top portion of the bottom tube 202. By fitting the leaf spring push button 201*a* into the opening 202*a*, the top tube 201 and bottom tube 202 forms one sturdy vertical tube 2. Such structure is commonly known.

Figure 11:
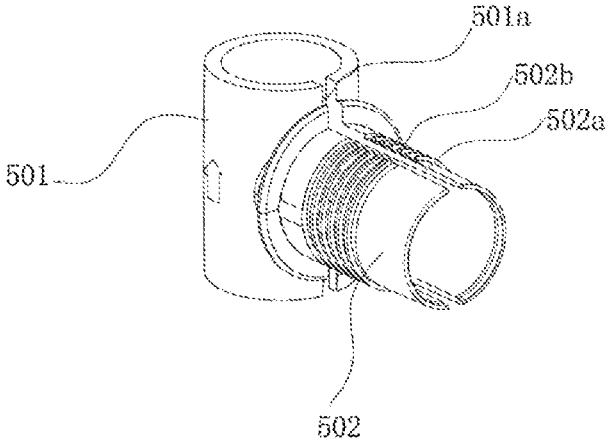
FIG. 11 is a perspective view of the tri-connect coupler according to an aspect of the disclosure.

Referring now to FIG. 11, the tri-connect coupler 5 can have a vertical slit 501*a* disposed on a side of the vertical tube body 501 where the vertical tube body 502 is disposed. There can be a horizontal slit 502*a* disposed on the top and bottom sides of the horizontal tube body 502, thereby dividing the horizontal tube body 502 into two liked arcuate pieces. These two arcuate pieces are an integral part of the vertical tube body 501. Each of these two arcuate pieces is disposed opposite of each other on opposite sides of the vertical slit 501*a*. The horizontal slit 502*a* connects with the vertical slit 501*a* to make one single slit disposed on the tri-connect coupler 5.

On the outside of the vertical tube body 502 can be disposed helical tracks 502*a* to receive complementary grooves disposed on the inside wall of the locking nut 503.

Figure 8:
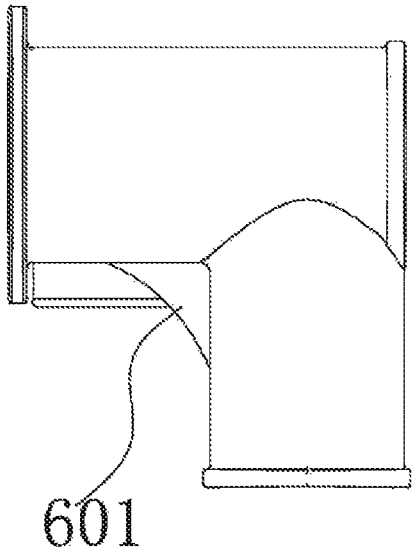
FIG. 8 is a front view of the tri-connect horn coupler of FIG. 7.

Referring now to FIG. 8, there can be a structural support piece 601 disposed on the tri-connect horn coupler 6 to strengthen the structural integrity of the coupler 6.

Figure 4:
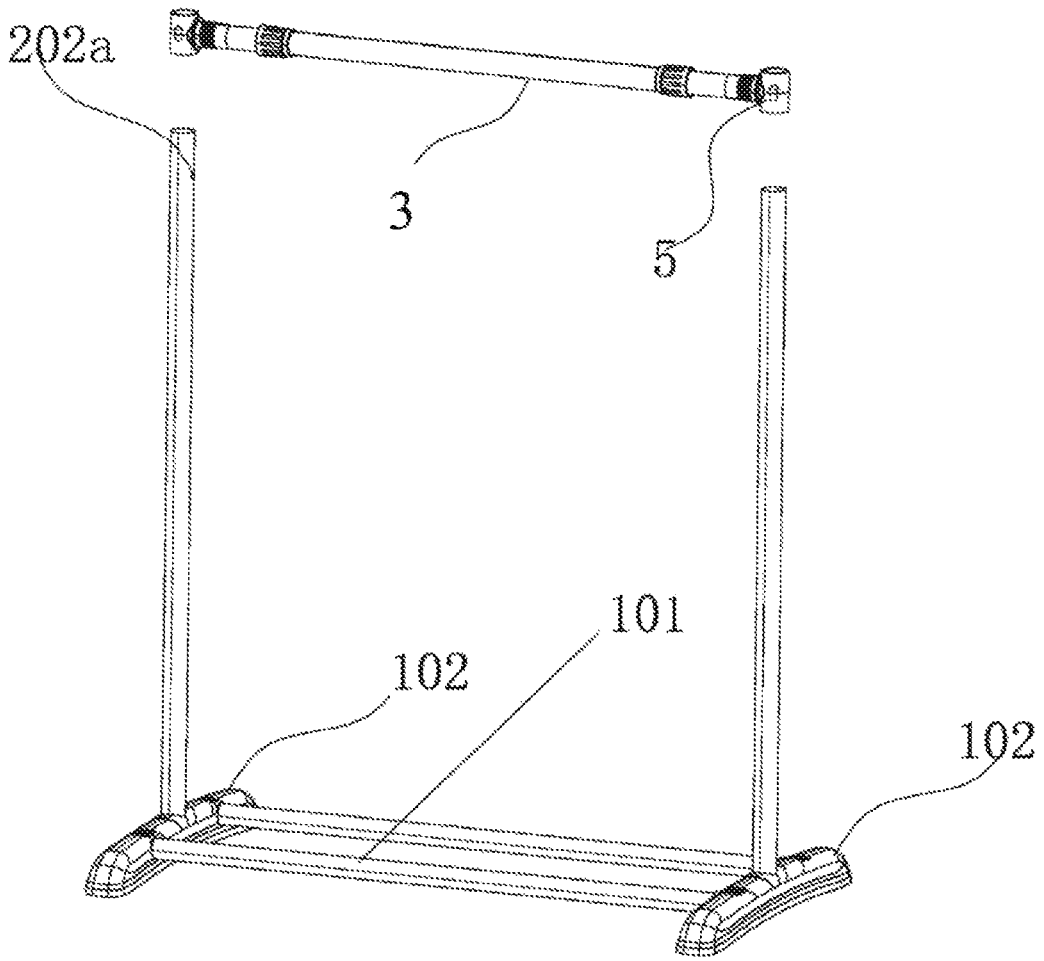
FIG. 4 illustrates the bottom portion of the embodiment of FIG. 1, wherein the top portion has been removed.
Figure 5:
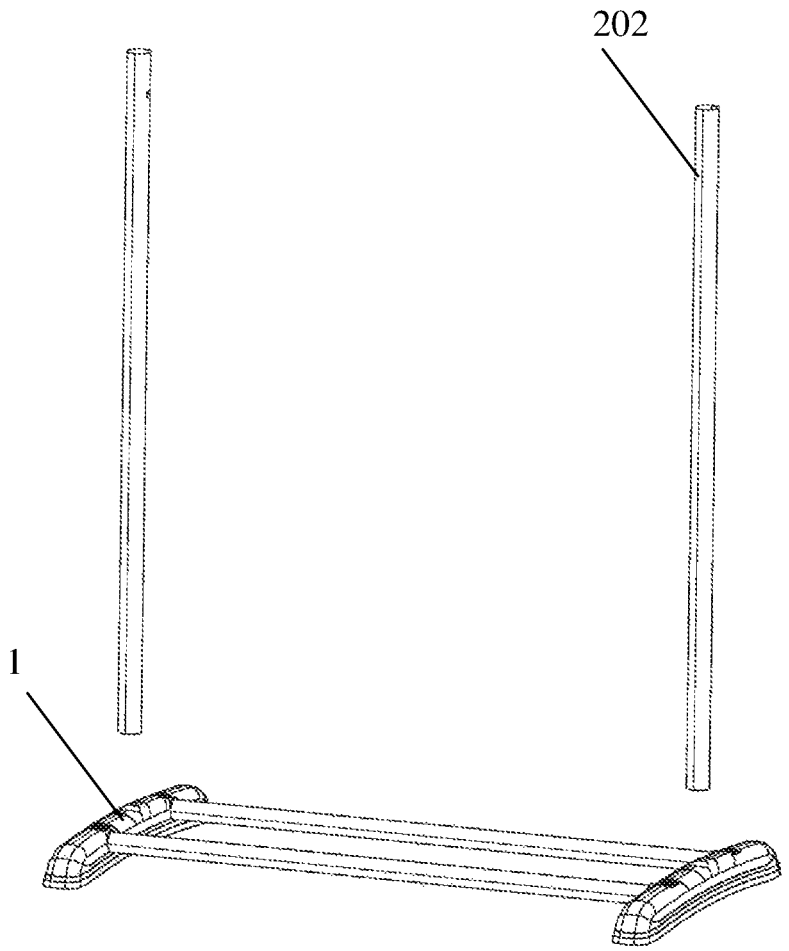
FIG. 5 illustrates the removal of two vertical tubes from the base of the embodiment of FIG. 1.
Figure 10:
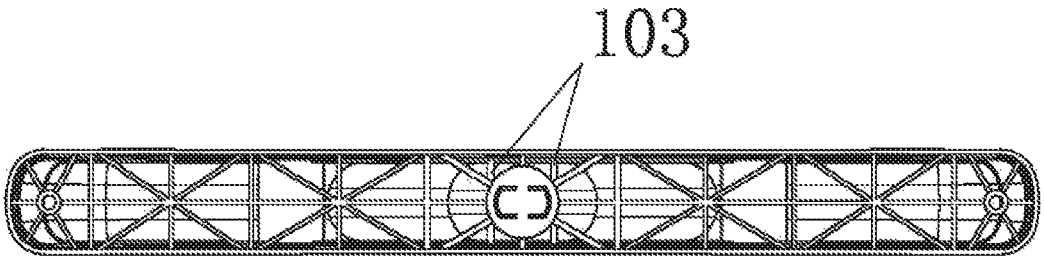
FIG. 10 is a bottom view of an end piece of the base showing two transversely disposed supports that provide structural integrity to the end piece.

Referring now to FIG. 4, similar to the base of known cloth racks, the herein disclosed base 1 can have two horizontal slats 101 coupled to two end pieces 102. The end piece 102 can be a plastic piece with a hollow interior. A bottom view of the end piece 102 is shown in FIG. 10. Within the hollow interior of the end piece 102 there can be two transversely disposed support pieces disposed near the end of the end piece 102. The two transversely disposed support pieces can provide structural integrity to the base 1.

Referring now to FIG. 3, the top horizontal tube 4 can have terminal extension pieces 7 disposed on either terminal ends of the top horizontal tube 4. Each extension piece 7 can have one or more scale notches 701 indicated on the side of the extension piece 7 so that a user would know the limit of the extension without overextending the extension pieces 7.

This is important because overextension may also damage the tri-connect horn coupler 6 when a heavy load of clothing forces the overextended extension piece 7 to collapse. If and when the tri-connect horn coupler is damaged, the entire cloth rack can be rendered useless.

Figure 7:
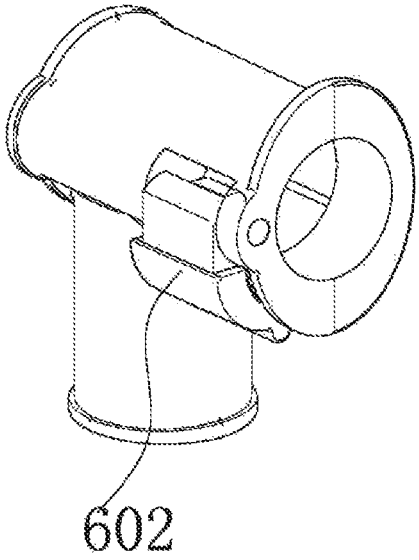
FIG. 7 is a perspective view of a tri-connect horn coupler, according to one aspect of the disclosure.

Referring now to FIG. 7, the tri-connect horn coupler 6 can have a locking clamp 602. Locking clamp 602 can lockingly secure the extension piece 7 in place. Releasing of the locking clamp 602 unlocks the extension piece 7 thereby allowing the extension piece 7 to be freely removed from the tri-connect horn coupler 6.

Figure 9:
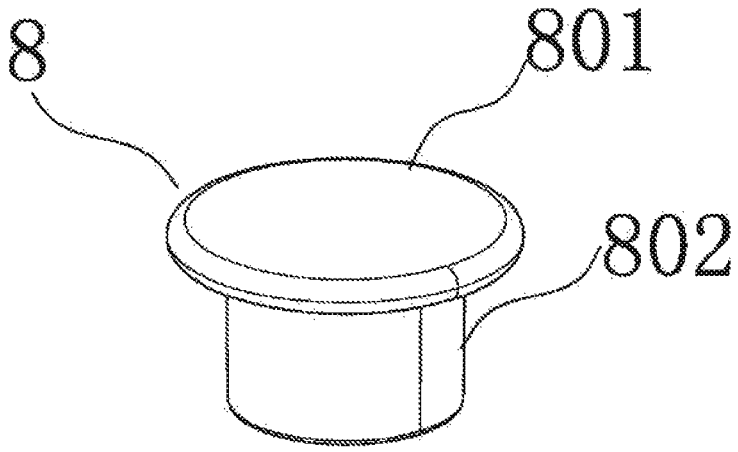
FIG. 9 is a perspective view of an end cap according to an aspect of the disclosure.

Referring now to FIGS. 3 and 9, where an end cap 8 is shown disposed within the extension piece 7. The end cap 8 can have a round disc top 801 and an integral tube insert 802. The end cap 8 can fittingly insert within a terminal end of the extension piece 7, which is hollow.

It will, nevertheless, be understood that no limitation of the scope of the disclosure is thereby intended; any alterations and further modifications of the described or illustrated embodiments and any further applications of the principles of the disclosure as illustrated therein are contemplated as would normally occur to one skilled in the art to which the disclosure relates.

What is claimed is:

1. A double-decker cloth rack comprising:

a base;

two bottom vertical tubes coupled to the base, each of said two bottom vertical tubes has a top end;

two tri-couplers;

a middle horizontal tube disposed between said two bottom vertical tubes, and has two terminal ends each of which is respectively coupled to each of said two tri-connect couplers;

each of said two tri-connect couplers is respectively coupled to said top end of each one of said two bottom vertical tubes;

two top vertical tubes;

a top horizontal tube disposed between said two top vertical tubes;

two tri-connect horn couplers each of which is coupled to said top end of each one of said two top vertical tubes;

two movable locking nuts freely disposed on the middle horizontal tube;

wherein each of said movable locking nuts is adapted to lockingly couple to a horizontal tubular extension of each of the two tri-connect couplers; and a vertical slit disposed on each of the two tri-connect couplers, and a horizontal slit disposed on the horizontal tubular extension, and wherein the horizontal slit is connected to the vertical slit.

2. The cloth rack as recited in claim 1 further comprising a helical track disposed on an outside of the horizontal tubular extension.

3. The cloth rack as recited in claim 1 further comprising an elbow corner support disposed on each of the two tri-connect horn couplers, and wherein the base includes two horizontal slats and two end pieces, and further comprising two transversely disposed supports provided within an interior of each end piece to provide structural integrity of the two end pieces.

4. The cloth rack as recited in claim 1 further comprising two extension pieces each of which is telescopically coupled to a terminal end of the top horizontal tube, and each of which has at least one notch provided thereon.

5. The cloth rack as recited in claim 4 further comprising two end caps each of which is disposed at a terminal end of each of the two extension pieces, wherein each of the two end caps includes a disc top integrally formed with a tubular insert piece.

6. A double-decker cloth rack comprising:

a base;

two bottom vertical tubes coupled to the base, each of said two bottom vertical tubes has a top end;

two tri-couplers;

a middle horizontal tube disposed between said two bottom vertical tubes, and has two terminal ends each of which is respectively coupled to each one of said two tri-connect couplers;

each of said two tri-connect couplers is respectively coupled to said top end of each one of said two bottom vertical tubes;

two top vertical tubes;

a top horizontal tube disposed between said two top vertical tubes;

two tri-connect horn couplers each of which is coupled to said top end of each one of said two top vertical tubes;

two movable locking nuts freely disposed on the middle horizontal tube;

wherein each of said movable locking nuts is adapted to lockingly couple to a horizontal tubular extension of the tri-connect coupler; and an elbow corner support disposed on each of the two tri-connect horn couplers, and wherein the base includes two horizontal slats and two end pieces, and further comprising two transversely disposed supports provided within an interior of each end piece to provide structural integrity of the two end pieces.

7. The cloth rack as recited in claim 6 further comprising a vertical slit disposed on each of the two tri-connect couplers, and a horizontal slit disposed on the horizontal tubular extension, and wherein the horizontal slit is connected to the vertical slit.

8. The cloth rack as recited in claim 7 further comprising a helical track disposed on an outside of the horizontal tubular extension.

9. The cloth rack as recited in claim 6 further comprising two extension pieces each of which is telescopically coupled to a terminal end of the top horizontal tube, and each of which has at least one notch provided thereon.

10. The cloth rack as recited in claim 9 further comprising two end caps each of which is disposed at a terminal end of each of the two extension pieces, wherein each of the two end caps includes a disc top integrally formed with a tubular insert piece.

* * * * *